US007254872B2

(12) United States Patent
Ross

(10) Patent No.: US 7,254,872 B2
(45) Date of Patent: Aug. 14, 2007

(54) BELT BUCKLE

(76) Inventor: Amara Ross, 3236 Golden Ave., Long Beach, CA (US) 90806

( * ) Notice: Subject to any disclaimer, the term of this patent is extended or adjusted under 35 U.S.C. 154(b) by 145 days.

(21) Appl. No.: 11/155,842

(22) Filed: Jun. 16, 2005

(65) Prior Publication Data

US 2006/0282991 A1 Dec. 21, 2006

(51) Int. Cl.
*A44B 11/00* (2006.01)

(52) U.S. Cl. ..... 24/163 K; 24/DIG. 48

(58) Field of Classification Search ..... None
See application file for complete search history.

(56) References Cited

U.S. PATENT DOCUMENTS

| | | | | | |
|---|---|---|---|---|---|
| 970,026 | A | * | 9/1910 | Duffy | 188/200 |
| 1,182,198 | A | * | 5/1916 | Noden | 24/577.1 |
| 1,429,641 | A | * | 9/1922 | Sayko | 40/640 |
| 1,825,045 | A | | 9/1931 | Blickhahn | |
| 1,882,475 | A | | 10/1932 | Blickhahn | |
| 2,125,775 | A | * | 8/1938 | Eisenman | 24/574.1 |
| 3,274,721 | A | | 9/1966 | Dreyer | |
| 3,927,442 | A | * | 12/1975 | Foster | 24/163 K |
| 4,052,773 | A | | 10/1977 | Nesbitt | |
| 4,053,966 | A | | 10/1977 | Dieleman | |
| 4,170,808 | A | | 10/1979 | Knowles | |
| 4,502,188 | A | * | 3/1985 | Kohli | 24/163 K |
| 4,570,308 | A | | 2/1986 | Weisgerber | |
| 4,688,303 | A | | 8/1987 | Williams et al. | |
| 4,753,377 | A | * | 6/1988 | Poluhowich | 224/163 |
| 4,771,557 | A | | 9/1988 | Bowman | |
| 4,916,779 | A | * | 4/1990 | Terada et al. | 24/593.1 |
| 5,184,352 | A | * | 2/1993 | Maufette | 24/579.09 |
| 5,197,213 | A | | 3/1993 | Borden | |
| 5,201,525 | A | | 4/1993 | Castro | |
| 5,245,775 | A | | 9/1993 | Goserud | |
| 5,259,136 | A | | 11/1993 | Goserud | |
| 5,335,433 | A | | 8/1994 | Borden | |
| 5,379,493 | A | * | 1/1995 | Wu | 24/163 K |
| 5,491,845 | A | * | 2/1996 | Takimoto | 2/338 |
| 6,098,252 | A | * | 8/2000 | Woerth, Jr. | 24/163 R |
| 6,108,821 | A | * | 8/2000 | Malsoute | 2/321 |
| 6,182,388 | B1 | | 2/2001 | Patton | |
| 6,886,724 | B2 | * | 5/2005 | Hung | 224/163 |
| 7,117,569 | B2 | * | 10/2006 | Bledsoe | 24/593.11 |

* cited by examiner

*Primary Examiner*—Jack W. Lavinder
(74) *Attorney, Agent, or Firm*—Orrick, Herrington & Sutcliffe LLP

(57) ABSTRACT

There is disclosed herein a decorative belt buckle comprising a base frame and a cover frame lockable with the base frame, and a tongue when it is inserted into the base frame thus creating a secondary lock. The cover frame includes a ratchet teeth mechanism for engaging ratchet teeth of an insertable tongue. One end of a belt can be fixed within a belt pocket of the base frame, and the other end of the belt can be fixed to an outer end of the tongue. Several forms or styles of covers are disclosed to provide a decorative cover in the form of a particular color or colors, artwork, or the entire cover frame may form a decorative cover.

7 Claims, 8 Drawing Sheets

BELT BUCKLE

FIELD OF THE INVENTION

The present invention relates generally to belt buckles, and more particularly to belt buckle designs having replaceable decorative covers such as ones to compliment clothing being worn by a person; however, the concepts of the present invention are applicable to other types of buckles, such as those for bracelets, hair clips, foot wear, animal collars, and the like.

BACKGROUND

Various forms of buckles have been developed over the years including those which are purely utilitarian, as well as various forms of decorative belt buckles. Belt buckles with a removable insert have been proposed, such as those shown in U.S. Pat. Nos. 6,182,388, 4,570,308, 4,052,773, 1,882,475, and 1,825,045. For the most part, these have been for the display of photographs, stamps and the like.

SUMMARY OF THE INVENTION

According to the present invention, a new and improved form of decorative belt buckle in several different forms is provided, and which enable various forms of decorative covers to be used on the face of the buckle. The buckle includes a mechanical system for simply and adjustably attaching the ends of a belt to the buckle mechanism, and readily allows firm adjustment of the belt with respect to the buckle.

Accordingly, a principal feature of the present invention is to provide improved forms of decorative belt buckles. Another feature of the present invention is to provide several different styles of decorative belt buckles.

BRIEF DESCRIPTION OF DRAWINGS

These and other features and objects of the present invention will become better understood through a consideration of the following description taken in conjunction with the drawings in which.

DETAILED DESCRIPTION

Figure 1A:
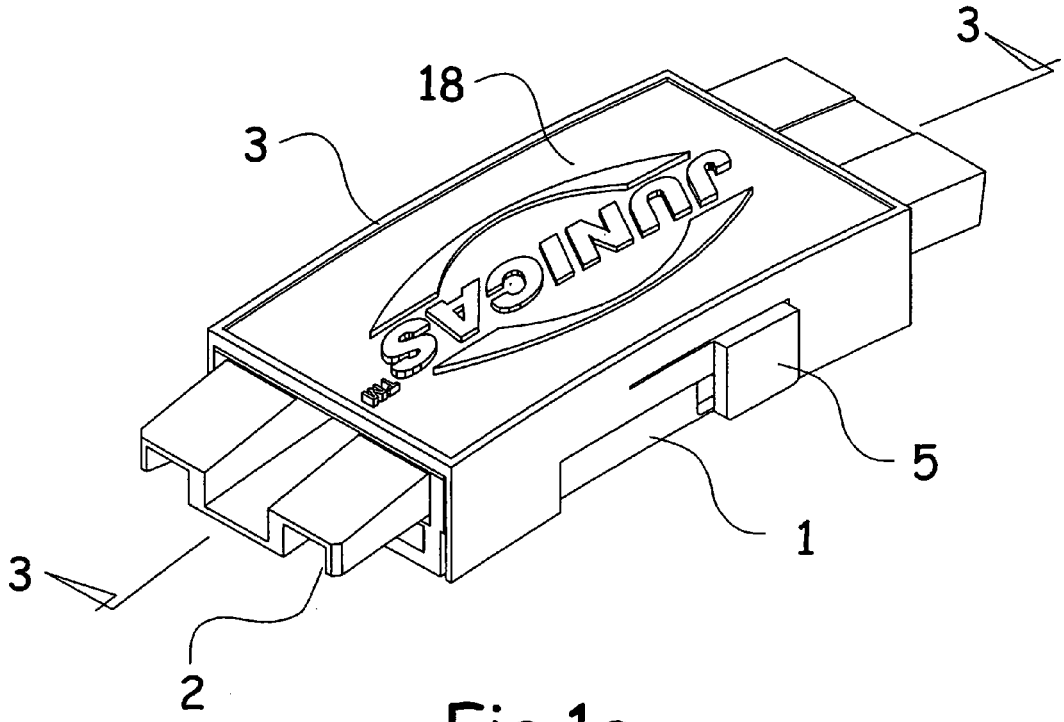
FIGS. 1*a*-1*d* illustrate a first form or style of assembled belt buckle according to the present invention.
Figure 1B:
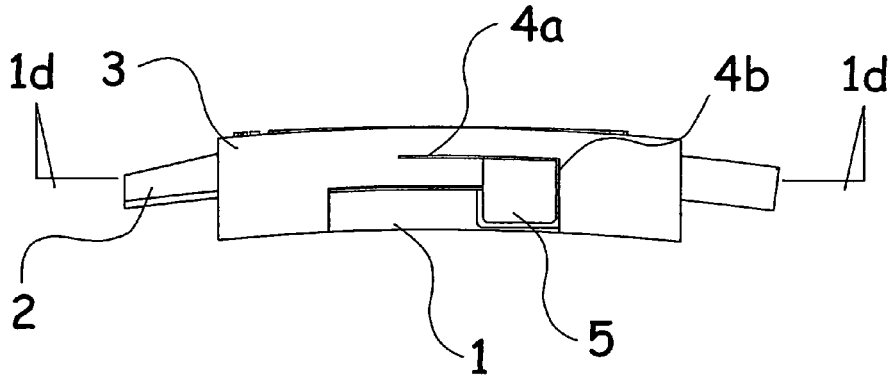
Figure 1C:
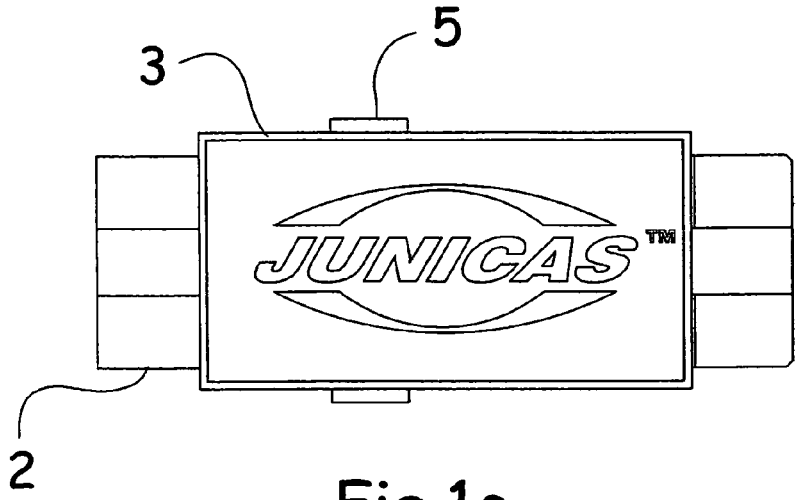
Figure 1D:
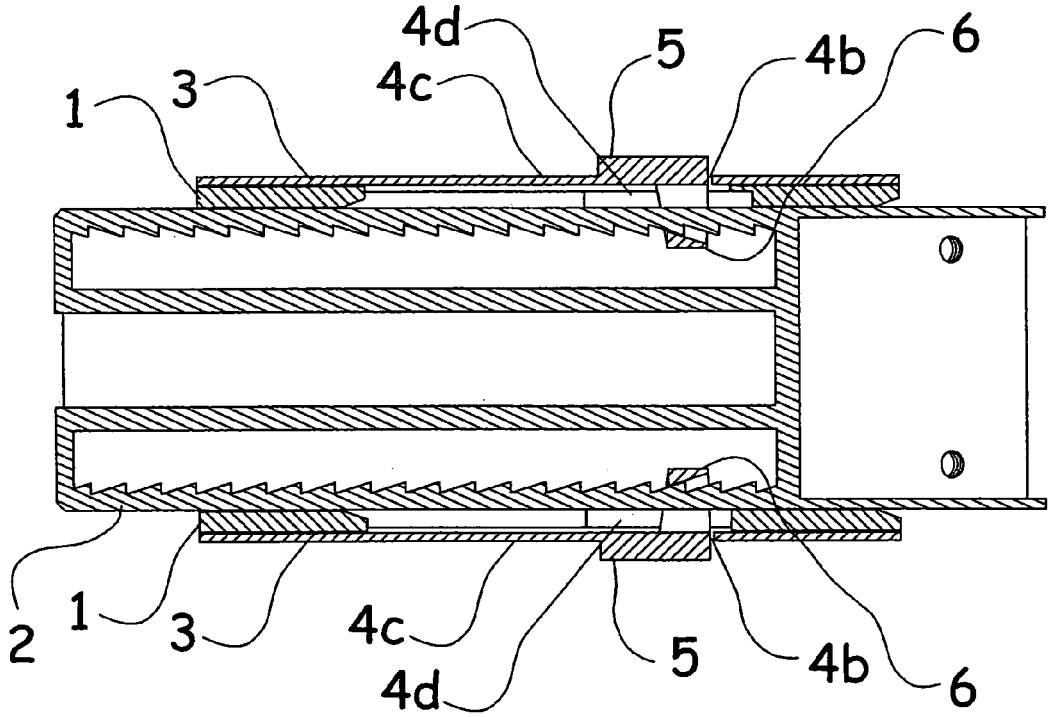
Figure 2:
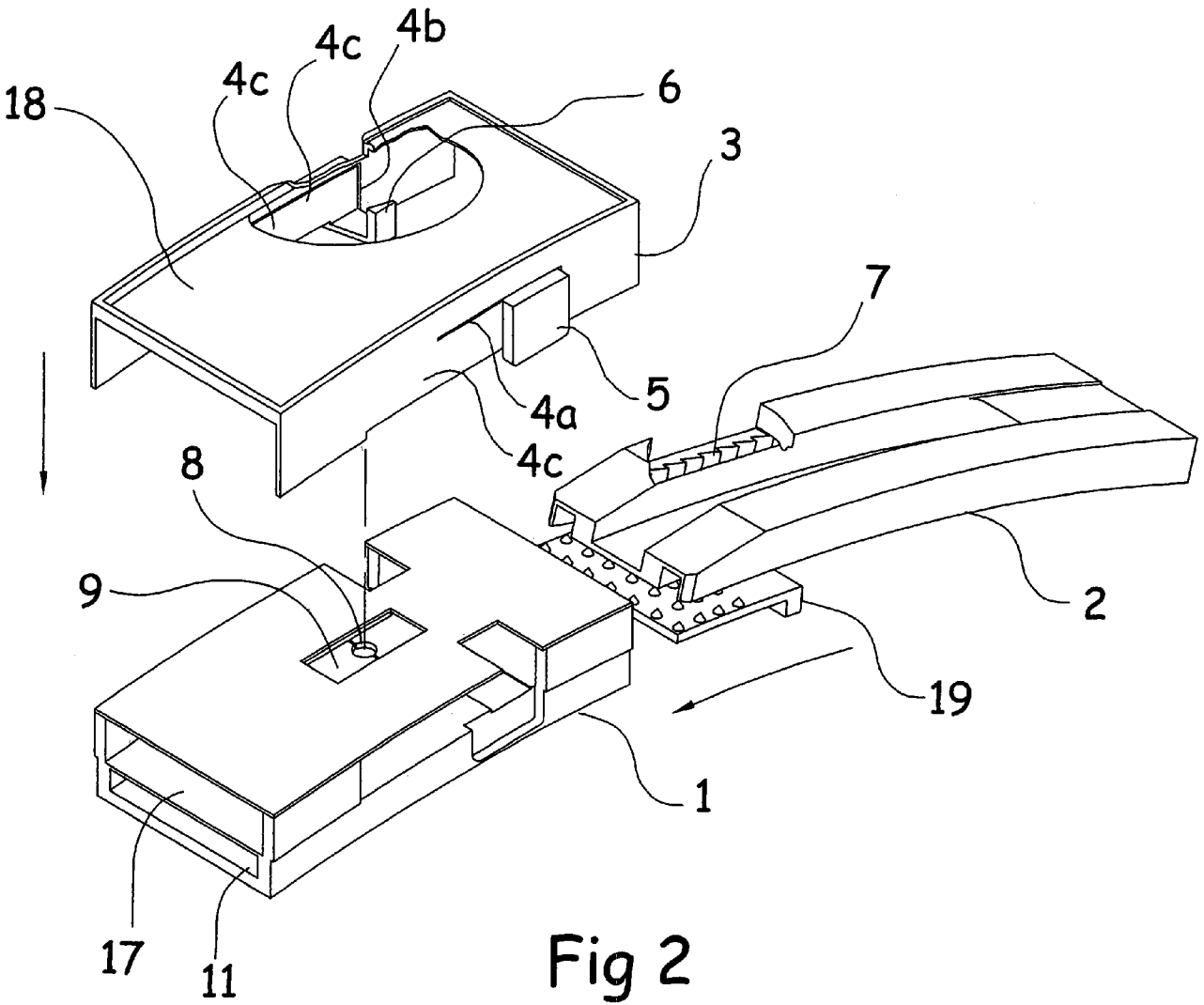
FIG. 2 shows an exploded view of individual components of the present belt buckle.

Turning now to the drawings, and particularly to FIGS. 1 through 4, a new form of decorative belt buckle is illustrated in detail. The buckle includes a base frame 1, a cover frame 3 including a locking system to be described, and a tongue 2. The buckle is more fully illustrated in the exploded view of FIG. 2 wherein the base frame 1 includes a belt pocket 11 for receiving a first end of a belt which is securely fixed within the pocket 11 as will be described subsequently, and a guide opening 17 for the tongue 2. The tongue 2 is seen to the right, and is elongated and includes a plurality of ratchet teeth 7 which are adjustably coupled with ratchet teeth mechanism 6 of the cover frame 3 when the tongue 2 is inserted. The cover frame 3 includes handles 5 for the ratchet locking mechanism 6, and the cover frame 3 is slit at 4*a* and 4*b* such that elongated sections for 4*c* form a spring to allow the ratchet teeth mechanism 6 to move inwardly as they are engaged by teeth 7 of the tongue 2 when the tongue is inserted into the base frame 1, and to be moved inwardly to release the tongue. The handles are depressed approximately one millimeter to release the tongue 2. The handles 5, ratchet teeth mechanism 6 section 4*c* are all integrally formed with the cover frame 3. Typically and preferably, the base frame 1, tongue 2, cover frame 3, and locking clip 19 are formed of metal such as aluminum and injection mold plastic, and preferably formed of glass-filled plastic such as GRIVORY GV-5H, but can be of other materials.

Figure 3:
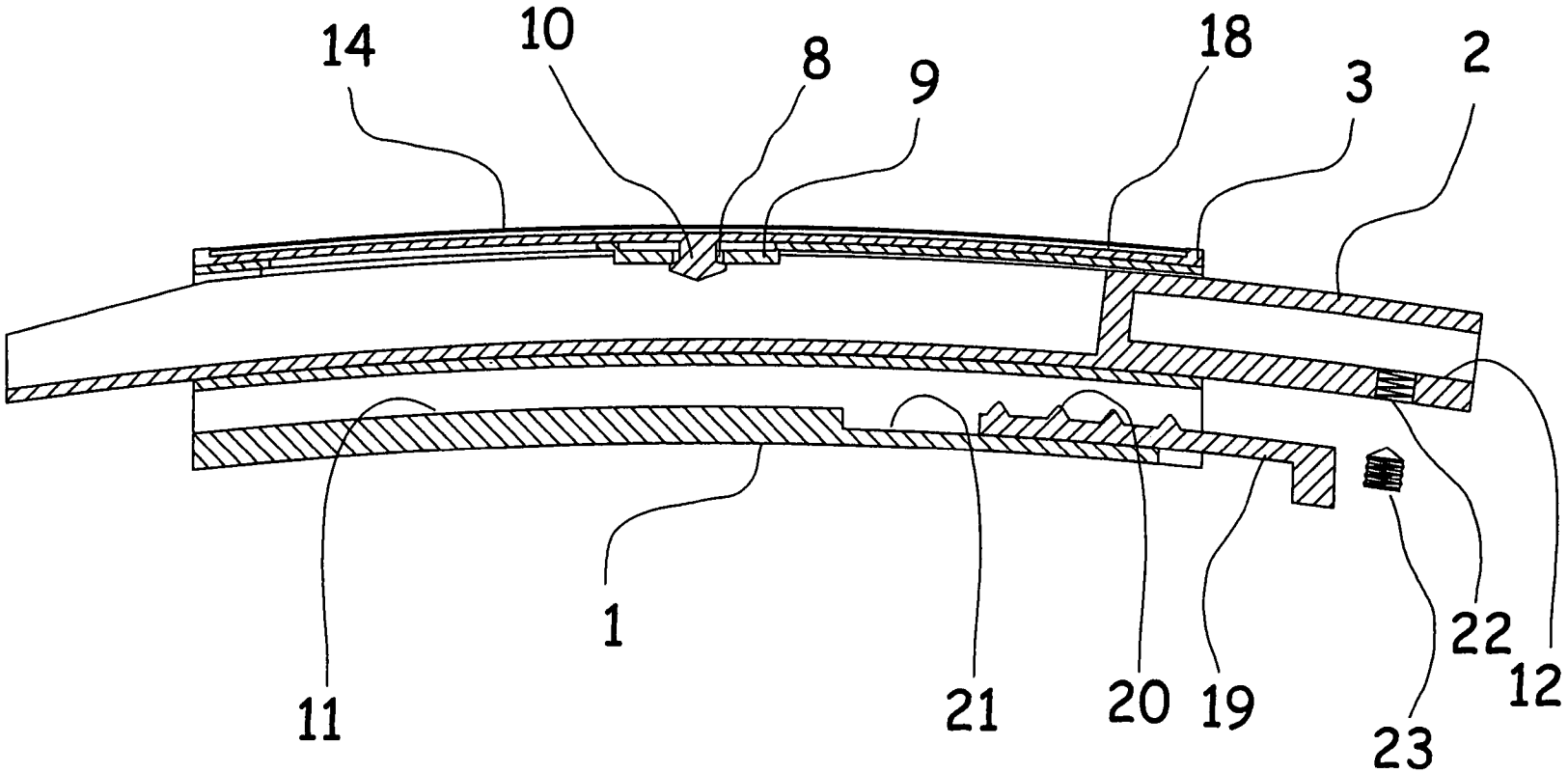
FIG. 3 is a cross-sectional view thereof taken along the line 3-3 of FIG. 1.
Figure 4:
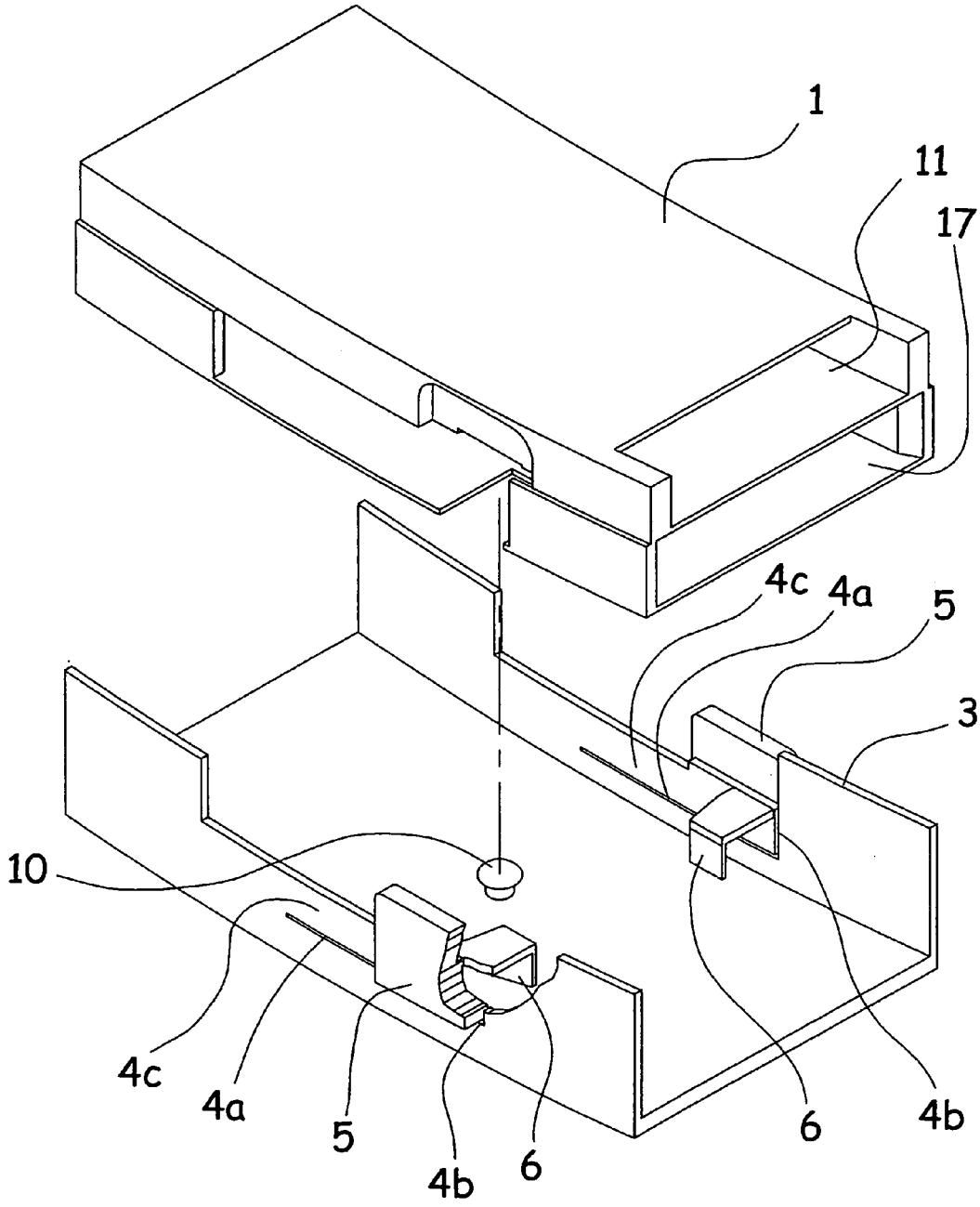
FIG. 4 is a view of the inside of the cover and locking system of the buckle.

FIGS. 3 and 4 illustrate a locking pin 10 of the cover frame 3 which extends through an opening 8 of a cover frame lock assembly 9 (FIG. 2) to secure the cover frame 3 to the upper area of the base frame 1 as best seen in the cross-sectional view of FIG. 3. FIG. 3 also better shows the belt pocket 11 and the base frame 1, as well as the belt pocket 12 on the tongue 2. One end of the belt (not shown) is secured in the outer end of the tongue 2 via a pair of set screws 23 secured in a like pair of tapped holes 22 in the lower outer end of the tongue 2. The other end of the belt is secured firmly within the belt pocket 11 of the base frame 1 by being either folded and wedged within the belt pocket 11 or by means of raised tips 20 of the locking clip 19 for the end of the belt. Thus, the belt is firmly secured within the belt pocket 11 in the base frame 1.

Figures 5A, 5B:
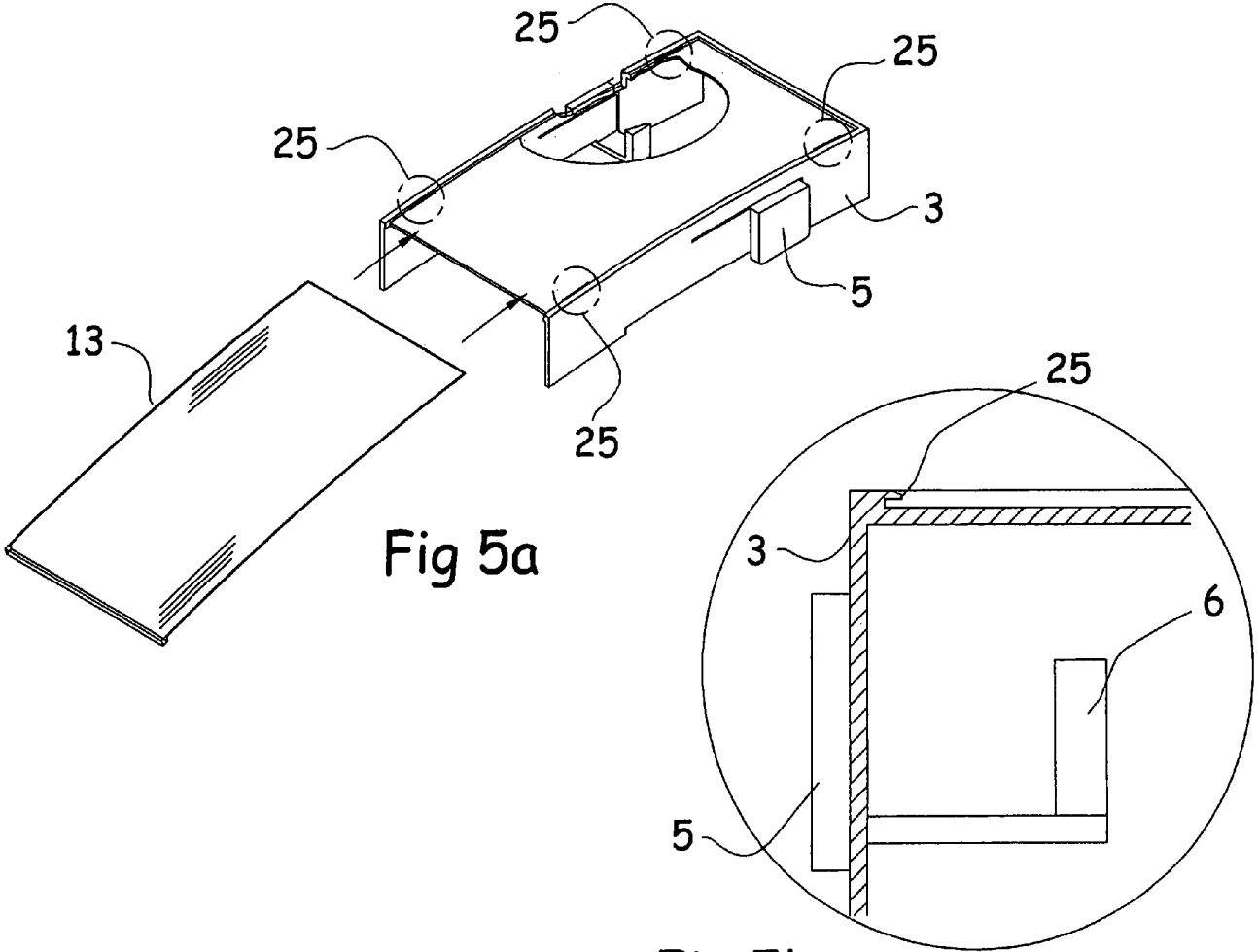
FIGS. 5 through 10 illustrate several different styles of belt buckles according to the present invention.

The foregoing particularly describes the components, structure and operation of the components of the belt buckle and how the tongue 2 and base frame/cover frame 3 are removably and adjustably interconnected. FIGS. 1 and 5 through 10 particularly illustrate different decorative cover arrangements for the outer face of the cover frame 3. The first style shown in FIG. 1 is the simplest wherein a pocket 18 is provided for receiving any form of decorative design. For example, it could receive a design within the pocket 18, or, alternatively the entire cover frame 3 can be colored, painted, etched, or the like to provide a decorative look to the belt buckle to compliment, for example, clothing worn by an individual, as well as wherever a buckle is needed such as a hair clip, handbag and the like. Similarly, a second style is shown in FIG. 5*a* and includes a decorative cover 13 which can be of any suitable form, such as a colored cover, a photograph, an artwork design or the like. The decorative cover 13 in FIG. 5*a* can simply be clipped onto the cover frame 3 via four catches 25 as shown in detail in FIG. 5*b*. Also, the cover 13 can be clear.

Figure 6:
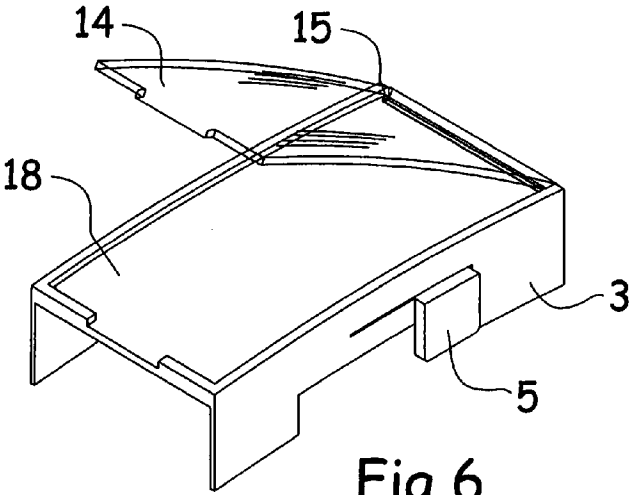

A third style is illustrated in FIG. 6 wherein a decorative cover in the form of a lid 14 hinged at 15 to the cover frame 3 is illustrated. This lid 14 likewise can be any form, color, design, or the like.

Figure 7:
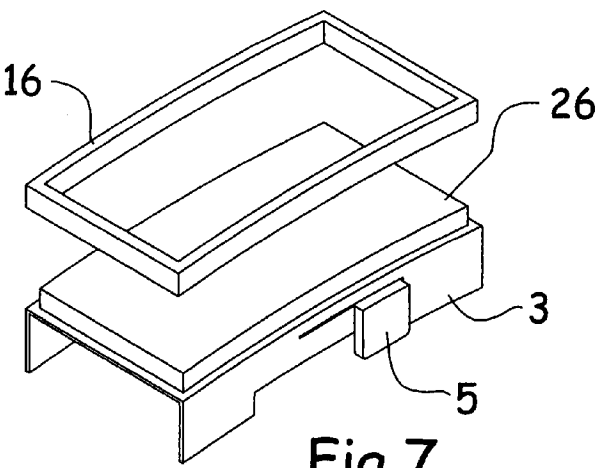
Figure 9:
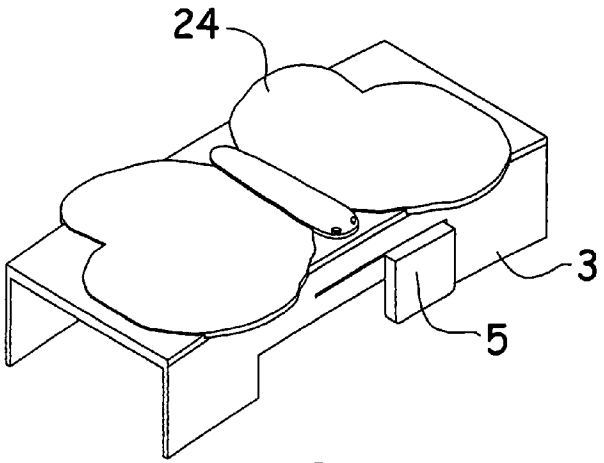
Figure 8:
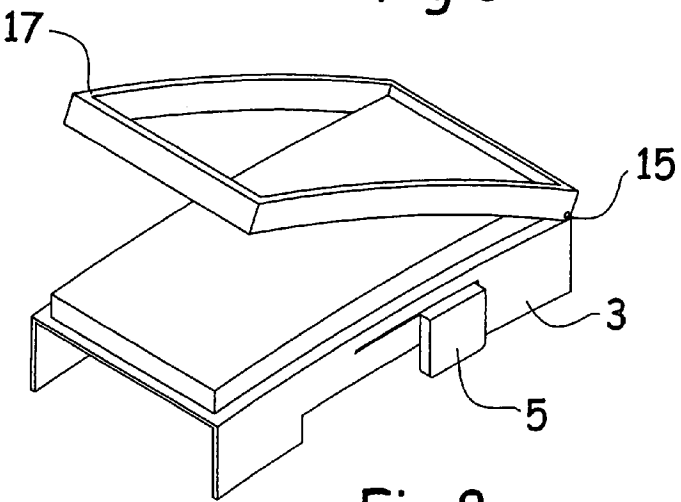
Figure 10:
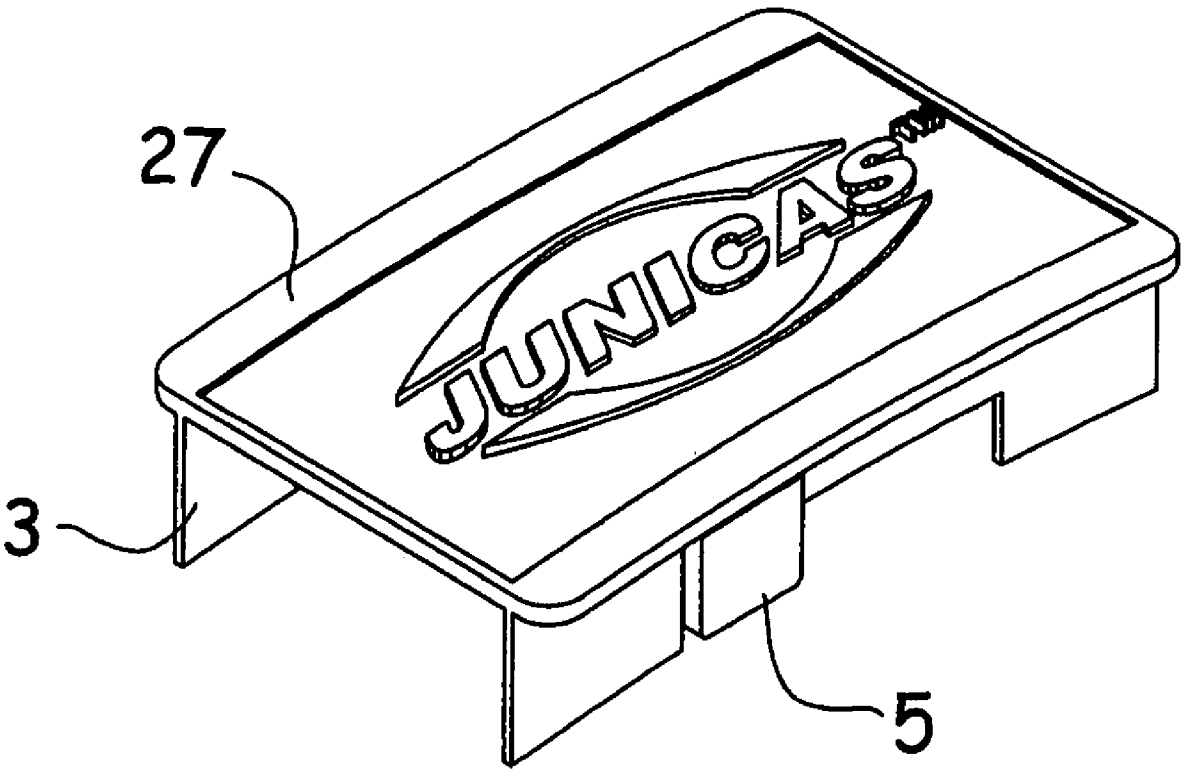

A fourth style is illustrated in FIG. 7 wherein the cover frame 3 has instead of a pocket 18 a raised section 26 onto which a frame cover 16 can be attached. A further style is illustrated in FIG. 8 wherein a hinged frame cover 17 is hinged at 15 to the cover frame 3. FIG. 9 shows a decorative design in the form of a butterfly 24 and other designs can be provided. FIG. 10 shows a logo or trademark design 27. FIGS. 6, 9 and 10 show a modified form of Section 4*c* and handle 5.

Appendix A is a list of various uses for the present invention.

What is claimed is:

1. A decorative belt buckle which can have various different decorative effects comprising a base frame, the base frame including a belt pocket for fixedly receiving a first end of a belt, and including a guide opening for a tongue, the base frame further including a cover frame lock assembly, a cover frame disposable on the base frame, and having a locking arrangement for locking the cover frame to the base frame, the cover frame further including a ratchet teeth mechanism for adjustably receiving a tongue, a tongue having a belt pocket for fixedly receiving the other end of a belt, and the tongue including a cooperative ratchet teeth mechanism for adjustably mating with the ratchet teeth mechanism of the cover frame, and the cover frame having an outer surface adapted to receive or comprise a decorative cover.

2. A belt buckle as in claim 1 wherein the outer surface of the cover frame includes a pocket for receiving a decorative design.

3. A belt buckle as in claim 2 wherein the decorative design comprises an attachable cover bracket.

4. A belt buckle as in claim 1 wherein the outer surface of the cover frame has a decorative cover lid hinged thereto.

5. A belt buckle as in claim 1 wherein the decorative cover comprises a frame hinged to the cover frame.

6. A belt buckle as in claim 1 wherein the ratchet teeth mechanism of the cover frame comprises a plurality of deflectable ratchet teeth formed integral with the cover frame and being movable with respect thereto for adjustably receiving the ratchet teeth of the tongue, and also use as a secondary locking mechanism with the tongue.

7. A belt buckle as in claim 1 wherein the cover frame includes a pin for fixedly attaching the cover frame to the base frame.

* * * * *